US011077665B2

(12) United States Patent
Squires et al.

(10) Patent No.: US 11,077,665 B2
(45) Date of Patent: Aug. 3, 2021

(54) DROP-ON-DEMAND PRINT HEAD CLEANING MECHANISM AND METHOD

(71) Applicant: Entrust Corporation, Shakopee, MN (US)

(72) Inventors: Milo B. Squires, Shakopee, MN (US); Kyle Johnson, Shakopee, MN (US); Eugene T. Tennis, Shakopee, MN (US)

(73) Assignee: Entrust Corporation, Shakopee, MN (US)

( * ) Notice: Subject to any disclaimer, the term of this patent is extended or adjusted under 35 U.S.C. 154(b) by 0 days.

(21) Appl. No.: 16/795,048

(22) Filed: Feb. 19, 2020

(65) Prior Publication Data

US 2020/0180315 A1 Jun. 11, 2020

Related U.S. Application Data

(62) Division of application No. 16/118,971, filed on Aug. 31, 2018, now Pat. No. 10,603,917.

(60) Provisional application No. 62/552,856, filed on Aug. 31, 2017.

(51) Int. Cl.
*B41J 2/165* (2006.01)
*B41M 5/00* (2006.01)

(52) U.S. Cl.
CPC ..... *B41J 2/16532* (2013.01); *B41J 2/16535* (2013.01); *B41J 2/16552* (2013.01); *B41M 5/0047* (2013.01)

(58) Field of Classification Search
CPC ..... B41J 2/16532; B41J 2/16552; B41J 2/16535; B41M 5/0047
See application file for complete search history.

(56) References Cited

U.S. PATENT DOCUMENTS

| | | | |
|---|---|---|---|
| 4,825,054 | A | 4/1989 | Rust et al. |
| 4,970,535 | A | 11/1990 | Oswald et al. |
| 5,151,715 | A | 9/1992 | Ward et al. |
| 5,266,781 | A | 11/1993 | Warwick et al. |
| 5,432,539 | A | 7/1995 | Anderson |
| 5,574,485 | A | 11/1996 | Anderson et al. |
| 5,617,124 | A | 4/1997 | Taylor et al. |
| 5,706,038 | A | 1/1998 | Jackson et al. |
| 5,790,146 | A | 8/1998 | Anderson |

(Continued)

FOREIGN PATENT DOCUMENTS

| | | | |
|---|---|---|---|
| JP | 2004230638 | A | 8/2004 |
| KR | 101101061 | B1 | 12/2011 |
| KR | 101385142 | B1 | 4/2014 |

OTHER PUBLICATIONS

International Search Report and Written Opinion issued in PCT/US2018/049051, dated Dec. 18, 2018; 18 pages.

*Primary Examiner* — Bradley W Thies
(74) *Attorney, Agent, or Firm* — Hamre, Schumann, Mueller & Larson, P.C.

(57) ABSTRACT

A card processing system includes a drop-on-demand card printing system that has at least one drop-on-demand print head with a nozzle plate. An automated cleaning mechanism is provided in the drop-on-demand card printing system that is configured to clean the nozzle plate without the cleaning mechanism physically contacting the nozzle plate. Since the nozzle plate is not physically contacted by the cleaning mechanism, damage to the nozzle plate during cleaning is avoided thereby avoiding degrading the resulting print quality of the print head.

3 Claims, 9 Drawing Sheets

(56) References Cited

U.S. PATENT DOCUMENTS

| | | | |
|---|---|---|---|
| 5,847,727 | A | 12/1998 | VanLiew et al. |
| 5,886,714 | A | 3/1999 | Burney et al. |
| 5,898,445 | A | 4/1999 | Becker et al. |
| 6,017,110 | A | 1/2000 | Jackson |
| 6,164,751 | A | 12/2000 | Griffin et al. |
| 6,241,337 | B1 | 6/2001 | Sharma et al. |
| 6,244,685 | B1 | 6/2001 | Yamada et al. |
| 6,250,736 | B1 | 6/2001 | Wojcik |
| 6,267,464 | B1 | 7/2001 | Furlani et al. |
| 6,273,103 | B1 | 8/2001 | Enz et al. |
| 6,290,324 | B1 | 9/2001 | Jackson et al. |
| 6,312,090 | B1 | 11/2001 | Griffin et al. |
| 6,334,662 | B2 | 1/2002 | Hollands |
| 6,343,850 | B1 | 2/2002 | Domagall |
| 6,347,858 | B1 | 2/2002 | Faisst, Jr. et al. |
| 6,406,122 | B1 | 6/2002 | Sharma et al. |
| 6,435,647 | B2 | 8/2002 | Faisst, Jr. et al. |
| 6,478,402 | B1 | 11/2002 | Greive |
| 6,511,150 | B1 | 1/2003 | Yoda et al. |
| 6,511,151 | B1 | 1/2003 | Griffin et al. |
| 6,523,930 | B2 | 2/2003 | Griffin et al. |
| 6,572,215 | B2 | 6/2003 | Sharma |
| 6,598,955 | B1 | 7/2003 | Tee et al. |
| 6,692,100 | B2 | 2/2004 | Steinfield et al. |
| 6,695,205 | B1 | 2/2004 | Lundstrom et al. |
| 6,758,549 | B2 | 7/2004 | Thiessen et al. |
| 6,783,067 | B2 | 8/2004 | Kreuter et al. |
| 6,886,907 | B1 | 5/2005 | Okamoto et al. |
| 6,902,107 | B2 | 6/2005 | Shay et al. |
| 6,916,080 | B2 | 7/2005 | Okamoto |
| 6,979,072 | B2 | 12/2005 | Lin |
| 7,004,559 | B2 | 2/2006 | Aliaga |
| 7,159,962 | B2 | 1/2007 | Wouters |
| 7,296,875 | B2 | 11/2007 | Chiu et al. |
| 7,350,897 | B2 | 4/2008 | Ciliberti et al. |
| 7,398,972 | B2 | 7/2008 | Schuller et al. |
| 7,434,728 | B2 | 10/2008 | Paulson et al. |
| 7,510,261 | B2 | 3/2009 | Karppinen et al. |
| 7,571,980 | B2 | 8/2009 | Deshon-Stepp et al. |
| 7,722,153 | B2 | 5/2010 | Karppinen et al. |
| 7,753,478 | B2 | 7/2010 | Hibbard et al. |
| 7,758,152 | B2 | 7/2010 | Hibbard et al. |
| 7,775,621 | B2 | 8/2010 | Chun |
| 7,815,282 | B2 | 10/2010 | Hibbard et al. |
| 7,819,500 | B2 | 10/2010 | Hibbard et al. |
| 7,832,834 | B2 | 11/2010 | Hibbard et al. |
| 7,874,636 | B2 | 1/2011 | Perrin et al. |
| 7,891,759 | B2 | 2/2011 | Guhse et al. |
| 7,891,763 | B2 | 2/2011 | Hibbard et al. |
| 7,909,450 | B2 | 3/2011 | Yamauchi et al. |
| 7,967,423 | B2 | 6/2011 | Katerberg |
| 8,313,165 | B2 | 11/2012 | Hibbard et al. |
| 8,360,551 | B2 | 1/2013 | Kagata et al. |
| 8,888,233 | B2 | 11/2014 | Muhl et al. |
| 8,979,244 | B2 | 3/2015 | Kritchman et al. |
| 9,016,831 | B2 | 4/2015 | Brenner et al. |
| 9,162,465 | B1 | 10/2015 | Tamarez Gomez et al. |
| 9,221,261 | B2 | 12/2015 | Love et al. |
| 9,259,933 | B1 | 2/2016 | Fima |
| 9,315,028 | B2 | 4/2016 | Berry et al. |
| 9,409,401 | B2 | 8/2016 | Jefferson et al. |
| 2005/0104926 | A1 | 5/2005 | Yamada et al. |
| 2016/0300128 | A1* | 10/2016 | Alvig ..... B41J 13/12 |

* cited by examiner

DROP-ON-DEMAND PRINT HEAD CLEANING MECHANISM AND METHOD

FIELD

This disclosure relates to card processing systems that process plastic cards including, but not limited to, financial (e.g., credit, debit, or the like) cards, driver's licenses, national identification cards, business identification cards, gift cards, and other plastic cards, and to transporting cards in such card processing systems.

BACKGROUND

In drop-on-demand printing, partially cured ink and other debris can accumulate on the print head nozzle plate (the surface of the print head that has a series of openings through which ink passes) and adversely affect the ink's flow and therefore the print quality. Regular cleaning of the nozzle plate is therefore often conducted. Many of the known techniques for cleaning the nozzle plate involve direct contact between the nozzle plate and a cleaning element such as a cloth or a brush. However, the nozzle plate surface is very delicate and can be easily damaged by excess pressure or abrasion. As a result, cleaning processes that directly contact the nozzle plate risks damaging the nozzle plate and thereby degrading the resulting print quality of the print head.

SUMMARY

Systems and methods are described where a card processing system includes a drop-on-demand card printing system that has at least one drop-on-demand print head with a nozzle plate. An automated cleaning mechanism is provided in the drop-on-demand card printing system that is configured to clean the nozzle plate without the cleaning mechanism physically contacting the nozzle plate. Since the nozzle plate is not physically contacted by the cleaning mechanism, damage to the nozzle plate during cleaning is avoided thereby avoiding degrading the resulting print quality of the print head.

The cards to be processed as described herein include, but are not limited to, plastic cards which bear personalized data unique to the intended cardholder and/or which bear other card information. Examples of plastic cards can include, but are not limited to, financial (e.g., credit, debit, or the like) cards, driver's licenses, national identification cards, business identification cards, gift cards, and other plastic cards.

The drop-on-demand card printing system can print using any suitable ink used in drop-on-demand printing and that is suitable for use on the types of cards described herein. For example, the ink can be an ultraviolet (UV) curable ink.

The drop-on-demand card printing system can have a single print head or a plurality of print heads. The drop-on-demand card printing system can perform monochromatic or multi-color printing. In one example of multi-color printing, five print heads, each of which has a nozzle plate, can be provided. Each print head can be designated to print a specific color ink, such as cyan, magenta, yellow, black and white (CMYKW).

The card processing system described herein can be any card processing system that can process cards such as by printing on the cards using the drop-on-demand card printing system, in combination with one or more of: reading data from and/or writing data to a magnetic stripe on the cards, programming an integrated circuit chip on the cards, emboss characters on the cards, indenting characters on the cards, laminating the cards, using a laser that performs laser processing such as laser marking on the cards, applying a topcoat to a portion of or the entire surface of the cards, checking the quality of personalization/processing applied to the cards, applying a security feature such as a holographic foil patch to the cards, and other card processing operations.

One card processing system described herein includes a card input that is configured to hold a plurality of cards to be processed and a card output that is configured to hold a plurality of processed cards. At least one of a magnetic stripe reading/writing system and an integrated circuit chip programming system is downstream of the card input and between the card input and the card output. In addition, a drop-on-demand card printing system is downstream of the card input, for example between the card input and the card output, which is configured to print on a card using UV curable ink. The drop-on-demand card printing system includes at least one drop-on-demand print head having a nozzle plate. The drop-on-demand card printing system further includes a cleaning mechanism that is configured to clean the nozzle plate of the at least one drop-on-demand print head without the cleaning mechanism physically contacting the nozzle plate. The card processing system also includes an UV curing station downstream from the card input, for example between the card input and the card output or between the printing system and the card output, where the UV curing station is configured to cure UV curable ink applied to a card by the drop-on-demand card printing system.

Another card processing system described herein can include a card input that is configured to hold a plurality of cards to be processed, a card output that is configured to hold a plurality of processed cards, a drop-on-demand card printing system downstream of the card input that is configured to print on a card, where the drop-on-demand card printing system includes at least one drop-on-demand print head having a nozzle plate. The drop-on-demand card printing system further includes a cleaning mechanism that is configured to clean the nozzle plate of the at least one drop-on-demand print head without the cleaning mechanism physically contacting the nozzle plate.

Still another card processing system described herein can include a card input that is configured to hold a plurality of cards to be processed, a card output that is configured to hold a plurality of processed cards, and a drop-on-demand card printing system downstream from the card input. The drop-on-demand card printing system is configured to print on a card using ultraviolet curable ink, and the drop-on-demand card printing system includes at least one drop-on-demand print head having a nozzle plate. In addition, the drop-on-demand card printing system further includes a cleaning mechanism that is configured to clean the nozzle plate of the at least one drop-on-demand print head without the cleaning mechanism physically contacting the nozzle plate. An ultraviolet curing station is downstream from the card input, for example downstream from the drop-on-demand card printing system, where the ultraviolet curing station is configured to cure ultraviolet curable ink applied to a card by the drop-on-demand card printing system.

A cleaning mechanism and cleaning method for cleaning the nozzle plate(s) of the drop-on-demand print head(s) are also described. The cleaning mechanism and method clean the nozzle plate without a physical structure such as a cleaning element directly contacting the nozzle plate. In one embodiment, a cleaning fluid can applied to the surface of the nozzle plate without a physical structure directly contacting the nozzle plate. In another embodiment, ink can be forced through the nozzles of the nozzle plate to unclog individual nozzles. Thereafter, a vacuum is used to remove the cleaning fluid (if used) and any loosened or residual ink and other debris from the surface of the nozzle plate. In the described cleaning mechanism and method, a portion of the cleaning mechanism may contact a portion(s) of the print head other than the nozzle plate. However, there is no direct physical contact between the cleaning mechanism and the nozzle plate.

DRAWINGS

DETAILED DESCRIPTION

Figure 1:
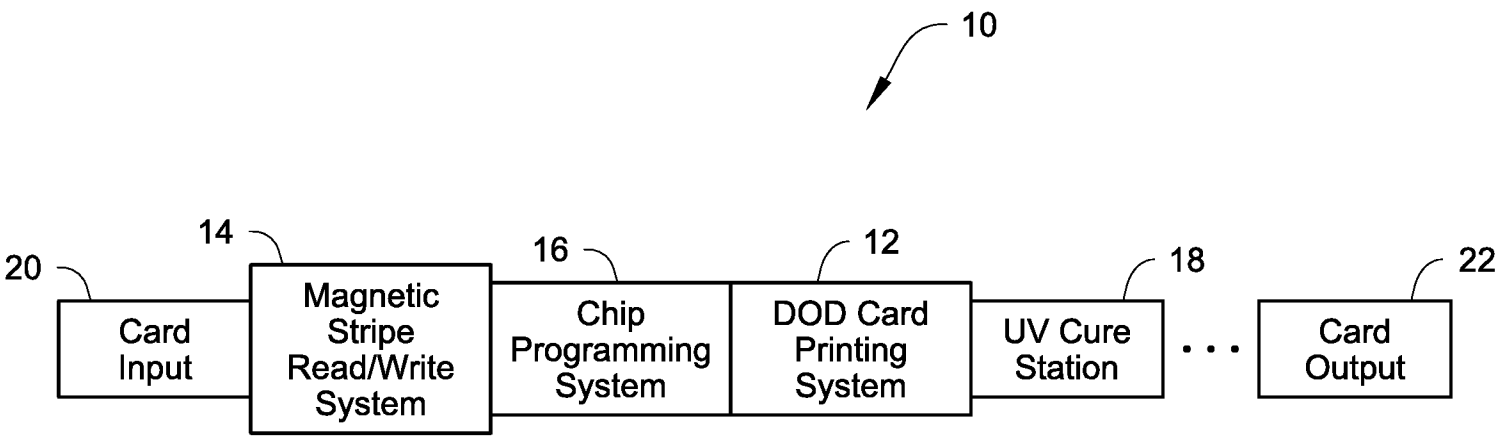
FIG. 1 illustrates a card processing system described herein.

FIG. 1 illustrates an example of a card processing system 10 described herein. The system 10 is configured to process cards by at least printing on the cards using a drop-on-demand (DOD) card printing system 12 included in the system 10. The system 10 can also include at least one other card processing capability in addition to the printing by the DOD card printing system 12. For example, the additional card processing can include a magnetic stripe read/write system 14 that is configured to read data from and/or write data to a magnetic stripe on the cards, and/or an integrated circuit chip programming system 16 that is configured to program an integrated circuit chip on the cards. When the DOD card printing system 12 prints using ultraviolet (UV) curable ink, a UV cure station 18 can also be provided. The construction and operation of the systems 14, 16, 18 is well known in the art. Magnetic stripe read/write systems and integrated circuit chip programming systems are disclosed, for example, in U.S. Pat. Nos. 6,902,107 and 6,695,205, and can be found in the MX family of central issuance systems available from Entrust Datacard Corporation of Shakopee, Minn. An example of a UV radiation applicator in a card printing system is the Persomaster card personalization system available from Atlantic Zeiser GmbH of Emmingen, Germany.

The cards to be processed as described herein include, but are not limited to, plastic cards which bear personalized data unique to the intended cardholder and/or which bear other card information. Examples of plastic cards can include, but are not limited to, financial (e.g., credit, debit, or the like) cards, driver's licenses, national identification cards, business identification cards, gift cards, and other plastic cards.

In the system 10 illustrated in FIG. 1, a card input 20 is provided that is configured to hold a plurality of cards waiting to be processed. Cards are fed one-by-one from the card input 20 into the rest of the system 10 where each card is individually processed. Processed cards are transported into a card output 22 that is configured to hold a plurality of the processed cards.

The card processing system 10 illustrated in FIG. 1 is a type of system that can be referred to as a central issuance card processing system. In a central issuance card processing system, the card input 20 and the card output 22 are generally at opposite ends of the system with the card processing mechanisms, such as the systems 12, 14, 16, 18 in FIG. 1, between the card input 20 and the card output 22. A central issuance card processing system is typically designed for large volume batch processing of cards, often employing multiple processing stations or modules to process multiple cards at the same time to reduce the overall per card processing time. Examples of central issuance card processing systems include the MX family of central issuance systems available from Entrust Datacard Corporation of Shakopee, Minn. Other examples of central issuance systems are disclosed in U.S. Pat. Nos. 4,825,054, 5,266,781, 6,783,067, and 6,902,107, all of which are incorporated herein by reference in their entirety. In one example, the card processing system 10 can process cards at a rate of at least about 500 cards per hour, or at least about 1000 cards per hour, or at least about 1500 cards per hour, or at least about 2000 cards per hour, or at least about 2500 cards per hour.

In FIG. 1, the systems 12, 14, 16, 18 are downstream of the card input 20 and between the card input 20 and the card output 22. The sequence or arrangement of the systems 12, 14, 16, 18 relative to one another and relative to the card input 20 can be varied from the sequence that is illustrated in FIG. 1.

The system 10 may include additional card processing systems not illustrated in FIG. 1, which are well known in the art of card processing and which may also be located between the card input 20 and the card output 22. For example, the system 10 may include a card embossing system that is configured to emboss characters on the cards; an indenting system that is configured to indent characters on the cards; a laminator system that is configured to apply a laminate to the cards; a laser system that uses a laser to perform laser processing such as laser marking on the cards; a topcoat station that is configured to apply a topcoat to a portion of or the entire surface of the cards; a quality control station that is configured to check the quality of personalization/processing applied to the cards; a security station that is configured to apply a security feature such as a holographic foil patch to the cards; and other card processing operations. The additional card processing systems may be located anywhere in the system 10, such as between the UV cure station 18 and the card output 22.

Figure 2:
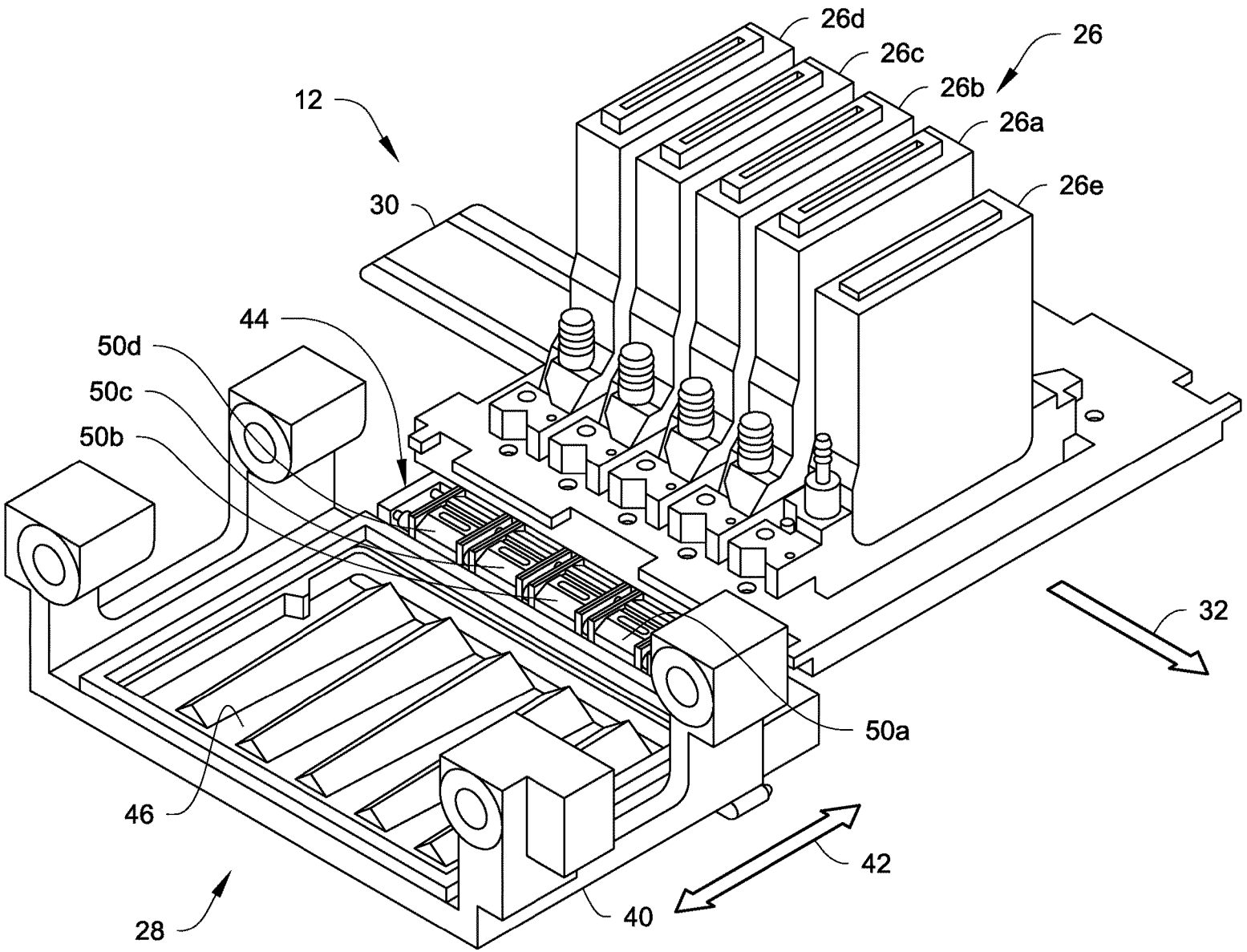
FIG. 2 illustrates select components of a drop-on-demand card printing system of the card processing system of FIG. 1.

FIG. 2 illustrates select components of the drop-on-demand card printing system 12. The system 12 includes at least one DOD print head 26 and an automated cleaning mechanism 28 that is configured to clean a nozzle plate of the DOD print head 26. The printing performed by the drop-on-demand card printing system 12 can be monochromatic or multi-color. FIG. 2 shows five DOD print heads 26*a-e* arranged side-by-side to sequentially print onto a surface of a card 30 as the card 30 is transported past the print heads 26*a-e*, for example underneath the print heads

26*a-e*, in the direction of the arrow 32. However, a smaller number of the DOD print heads, including one of the DOD print heads, or a larger number of the DOD print heads, can be used.

The DOD print heads 26*a-e* can print using any suitable ink or coating used in drop-on-demand printing and that is suitable for use on the types of cards described herein. For example, the ink can be a UV curable ink, a heat curable ink that can be cured by applying heat to the heat curable ink, or other ink or materials that can be deposited by DOD print heads. In the case of the five DOD print heads 26*a-e*, each DOD print head can print a specific color ink. For example, the DOD print head 26*d* can print cyan colored ink, the DOD print head 26*c* can print magenta colored ink, the DOD print head 26*b* can print yellow colored ink, the DOD print head 26*a* can print black ink, and the DOD print head 26*e* can print white ink. An example of a drop-on-demand printer that prints using UV curable ink in a card printing system is the Persomaster card personalization system available from Atlantic Zeiser GmbH of Emmingen, Germany.

Figure 5:
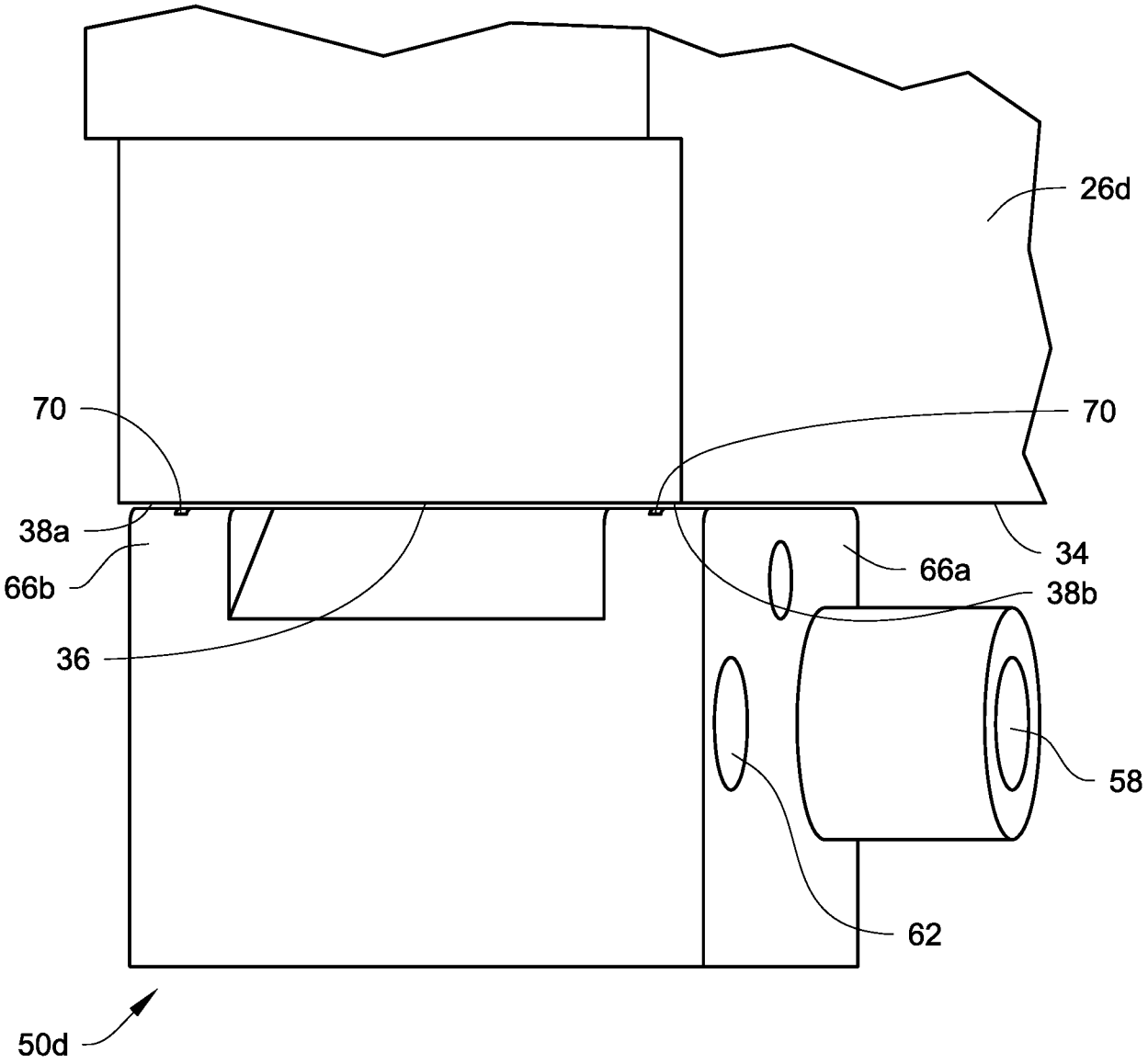
FIG. 5 illustrates a positional relationship between one of the cleaning blocks and one of the print heads during cleaning.

FIG. 5 is a close-up view of one of the DOD print heads, for example the DOD print head 26*d*. The other DOD print heads 26*a-c,e* can have an identical construction as the DOD print head 26*d*. However, the construction of the print heads 26*a-e* can differ from one another. The construction and operation of the DOD print head 26*d* is identical to the construction and operation of DOD print heads known in the art. The DOD print head 26*d* includes a bottom surface 34 that faces downward toward the card to be printed on. A nozzle plate 36, through which ink is ejected, is provided on a portion of the bottom surface 34 generally centrally thereon leaving side portions 38*a*, 38*b* of the bottom surface 34 not covered by the nozzle plate 36.

Returning to FIG. 2, the automated cleaning mechanism 28 is configured to clean the nozzle plates 36 of the DOD print heads 26*a-e* without physically contacting the nozzle plates 36. The automated cleaning mechanism 28 can have any configuration that is capable of automatically cleaning the nozzle plates 36 without physically contacting the nozzle plates 36.

In the example illustrated in FIG. 2, the automated cleaning mechanism 28 includes a cleaning carriage 40 that is movable underneath the DOD print heads 26*a-e* back and forth in the direction of the arrow 42 (generally perpendicular to the transport direction 32 of the card 30) relative to the DOD print heads 26*a-e*. FIG. 2 shows the cleaning carriage 40 in a home or non-cleaning position. The cleaning carriage 40 can be actuated from the home position in a direction toward and underneath the DOD print heads 26*a-e*, and thereafter back to the home position.

A cleaning assembly 44 is mounted on the cleaning carriage 40 near one end thereof and is movable therewith. In addition, a drip tray 46 is formed on the cleaning carriage 40 next to and to the rear of (in the direction of movement of the cleaning carriage 40 toward the DOD print heads 26*a-e*) the cleaning assembly 44 so that at the home position shown in FIG. 2 the cleaning assembly 44 is initially closer to the DOD print heads 26*a-e* than is the drip tray 46. The cleaning assembly 44 is configured to clean the nozzles plates 36 without physically contacting the nozzle plates 36. The drip tray 46 provides an area for cleaning fluid along with loosened ink and other debris to drip onto, where the cleaning fluid has been applied to the nozzles plates 36 during a cleaning process by the cleaning assembly 44. The drip tray 46 has an area that is large enough to encompass at least the total area of the nozzle plates 36.

In the example illustrated in FIG. 2, the cleaning assembly 44 includes a plurality of individual and separate cleaning blocks 50*a-e*, each cleaning block 50*a-e* being associated with a respective one of the DOD print heads 26*a-e*. The cleaning block 50*e* for the print head 26*e* is hidden from view in FIG. 2 but is partially visible in FIGS. 6A and 6B and is located next to (i.e. to the right of) the cleaning block 50*a*. For example, the cleaning block 50*a* can be associated with the DOD print head 26*a* for cleaning the DOD print head 26*a*; the cleaning block 50*b* can be associated with the DOD print head 26*b* for cleaning the DOD print head 26*b*; etc. Each cleaning block 50*a-e* can be independently movably mounted on the cleaning carriage 40 wherein each cleaning block 50*a-e* can be movable independently of the other cleaning blocks and each cleaning block 50*a-e* is movable relative to the cleaning carriage 40.

Figure 3:
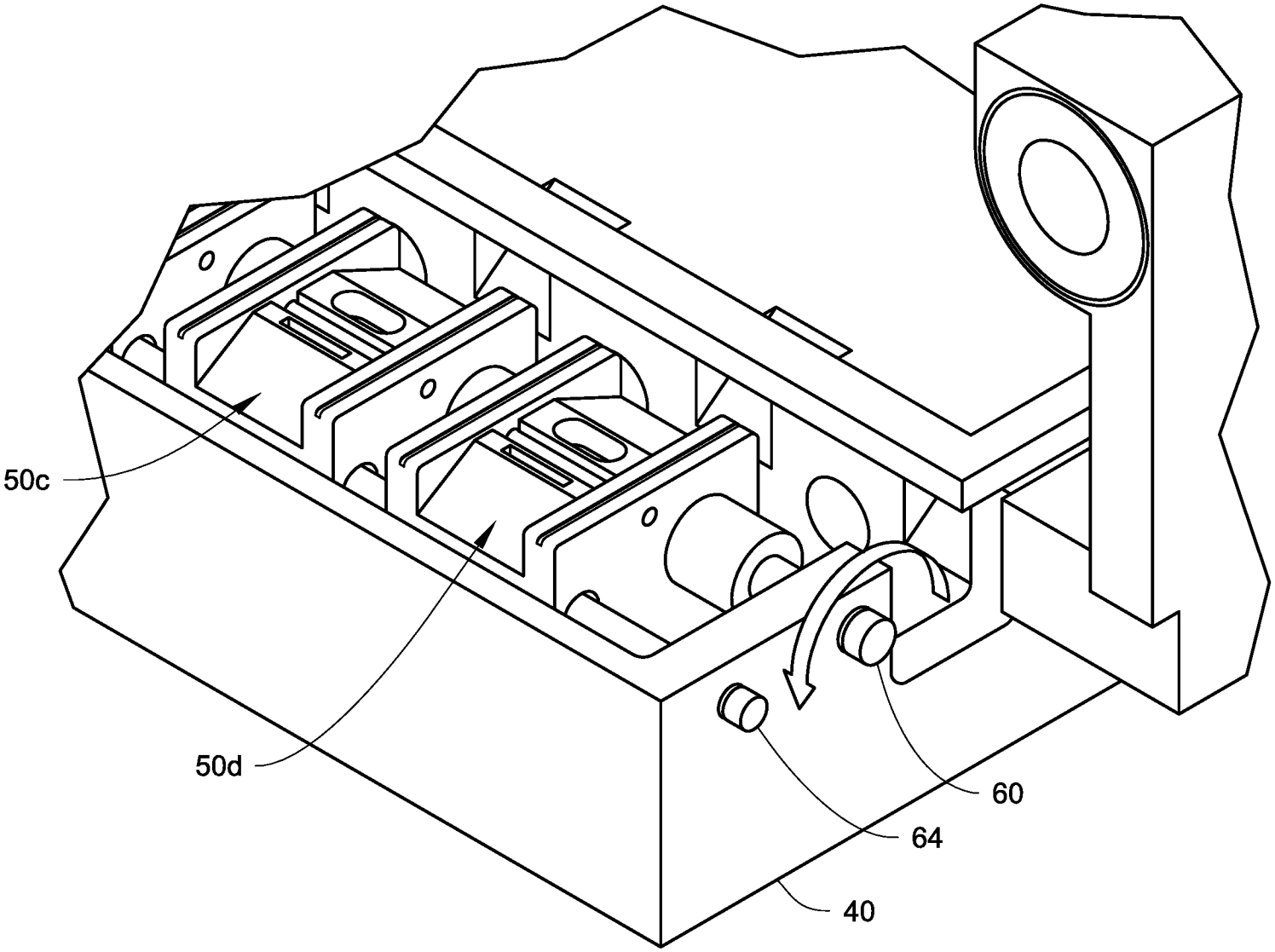
FIG. 3 is a close-up view of the cleaning blocks of the cleaning mechanism of the drop-on-demand card printing system.
Figure 4:
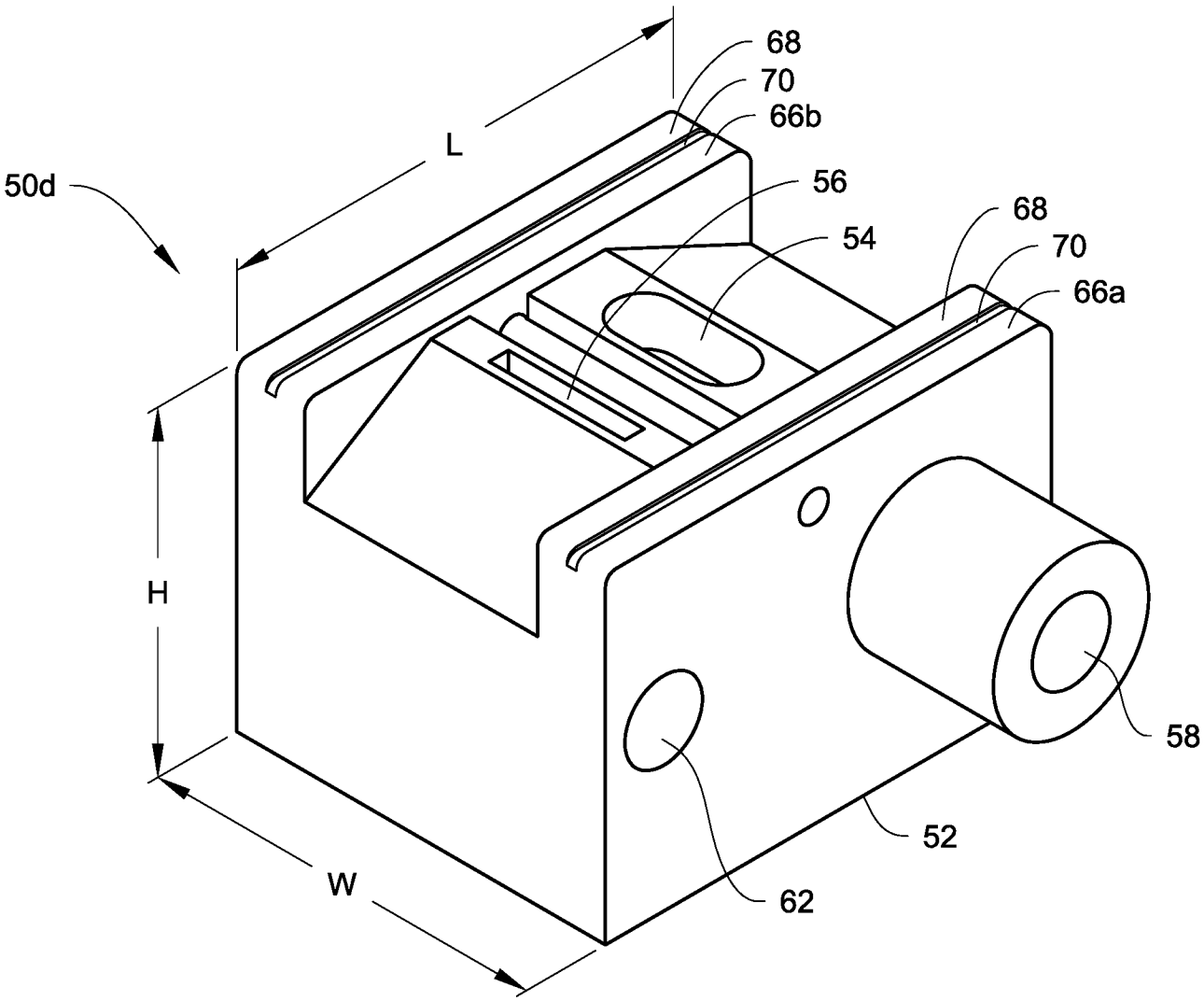
FIG. 4 is a detailed view of one of the cleaning blocks.

The cleaning blocks 50*a-e* can be identical in construction to one another. In another example, some of the cleaning blocks 50*a-e* may be different from one another, for example to optimize cleaning blocks for different print head geometries. Referring to FIGS. 3 and 4, the cleaning block 50*d* will be described, it being understood that the other cleaning blocks 50*a-c, e* can have the same construction. The cleaning block 50*d* has a block body 52 having a length L, a width W, and a height H. A flush orifice 54 and a vacuum orifice 56 are defined near the top of the block body. The flush orifice 54 is configured to apply a cleaning fluid to the nozzle plate 36. The vacuum orifice 56 is configured to remove the cleaning fluid along with any loosened ink and other debris from the nozzle plate 36.

A pivot opening 58 is formed in, for example through, the block body 52 extending in the direction of the width W of the bock body 52. As shown in FIG. 3, a pivot shaft 60 extends through the aligned pivot openings 58 of the block bodies 52 of the cleaning blocks 50*a-e*. The pivot shaft 60 is fixed to the cleaning carriage 40, and the block bodies 52 of the cleaning blocks 50*a-e* can individually and separately pivot about the pivot shaft 60.

Returning to FIG. 4, the block body 52 further includes a pivot limiting opening 62 that extends in the direction of the width W of the block body 52 parallel to the pivot opening 58. The pivot limiting opening 62 is spaced from the pivot opening 58 in the direction of the length L of the block body 52. As seen in FIG. 3, a shaft 64 that is fixed to the cleaning carriage 40 extends through the aligned pivot limiting openings 62 of the block bodies 52. The pivot limiting opening 62 has a diameter that is greater than the diameter of the shaft 64. The pivot range of the block body 52 about the pivot shaft 60 is limited by the clearance between the diameter of the shaft 64 and the diameter of the pivot limiting opening 62.

The pivotable mounting of the cleaning blocks 50*a-e* permits each individual cleaning block to self-adjust a small distance toward and away from its associated DOD print head 26*a-e*, with the adjustment distance limited by the clearance between the diameter of the shaft 64 and the diameter of the pivot limiting opening 62.

Returning to FIG. 4, the block body 52 also includes first and second side rails 66*a*, 66*b*. The first and second side rails 66*a*, 66*b* extend in the direction of the length L of the block body 52, and in the illustrated example extend the entire length L of the block body 52. The first and second side rails 66*a*, 66*b* are spaced from each other in the direction of the width W of the block body 52, with the flush orifice 54 and the vacuum orifice 56 disposed between the first and second side rails 66*a*, 66*b*. Each of the first and second side rails 66*a*, 66*b* has an upper edge 68, and the upper edge 68 is spaced above the flush orifice 54 and the vacuum orifice 56, i.e. the flush orifice 54 and the vacuum orifice 56 are located a distance below the upper edges 68 of the side rails 66*a*, 66*b*. A wear indicator groove 70 is formed in the upper edge 68 of each of the side rails 66*a*, 66*b* and extends the entire length of each side rails 66*a*, 66*b*. The wear indicator groove 70 provides an indication when the cleaning block 50*d* is worn to the point of needing replacement.

Referring to FIG. 5, during a cleaning operation, the cleaning block 50*d* is positioned close to the bottom surface 34 of the DOD print head 26*d*, with the upper edges 68 of the side rails 66*a*, 66*b* in close proximity to (but not in direct physical engagement with) or in direct physical engagement with the side portions 38*a*, 38*b* next to the nozzle plate 36, and the cleaning orifice 54 and the vacuum orifice 56 spaced below the nozzle plate 36. Although the cleaning block 50*d* may physically contact the DOD print head 26*d*, no portion of the cleaning block 50*d* is in direct physical contact with the nozzle plate 36.

Figure 8:
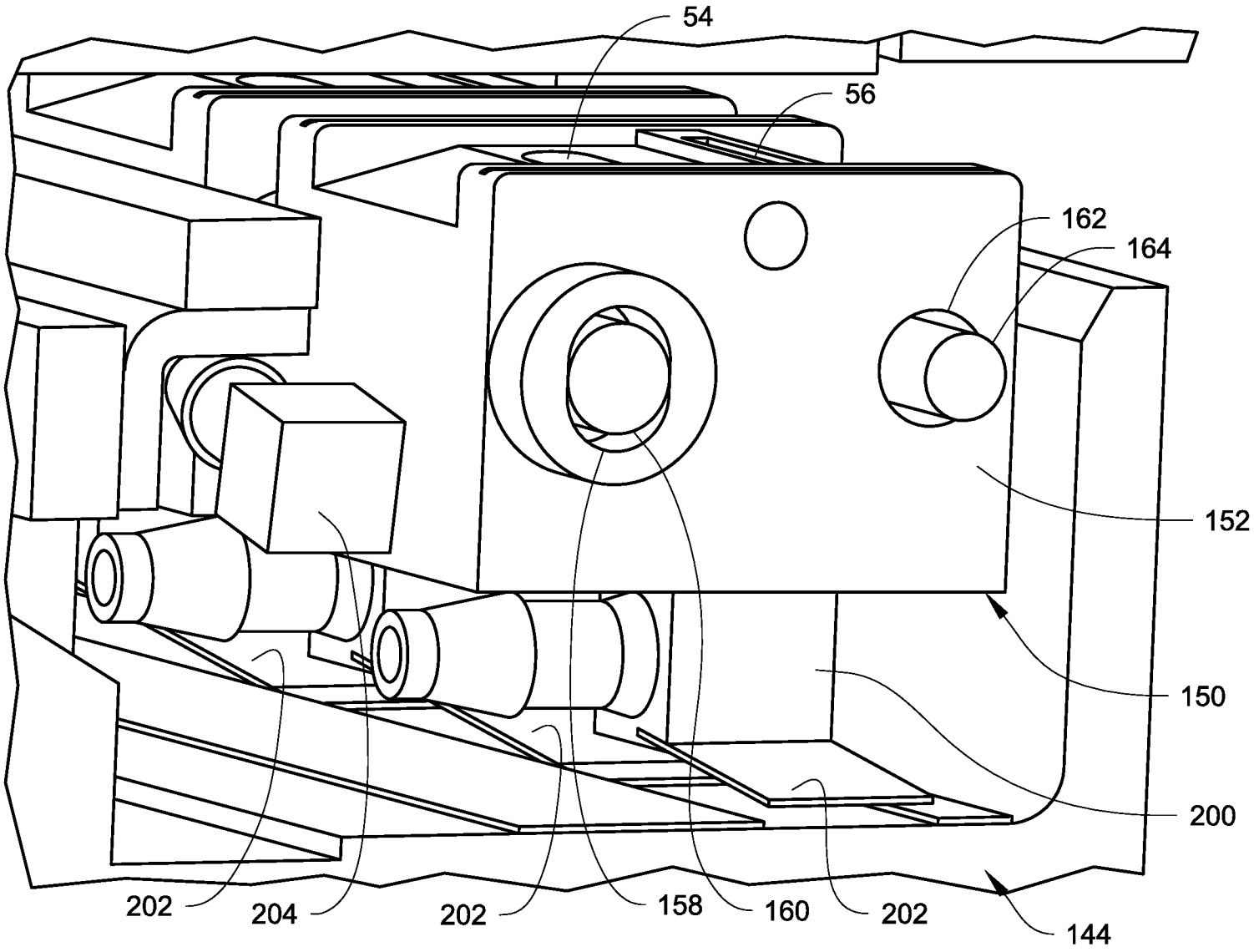
FIG. 8 illustrates another embodiment of the cleaning blocks described herein.

FIG. 8 shows another embodiment of a cleaning assembly 144 where cleaning blocks 150 for each print head can move in a vertical direction in order to self-adjust a small distance toward and away from its associated DOD print head. In this embodiment, each cleaning block 150 includes a block body 152 that is generally similar to the construction of the block body 52. However, the block body 152 includes a vertically elongated (or oval) opening 158 and another opening 162. A shaft 160 extends through the aligned openings 158 of the block bodies 152. As with the pivot shaft 60, the shaft 160 is fixed to the cleaning carriage of the cleaning assembly 144, and the block bodies 152 can individually and separately move vertically up and down (in a linear direction) toward and away from their respective print heads. In addition, a shaft 164 that is fixed to the cleaning carriage extends through the aligned openings 162 of the block bodies 152. The opening 162 has a diameter that is greater than the diameter of the shaft 164. The extent of vertical movement of the block body 152 is limited by the clearance between the diameter of the shaft 164 and the diameter of the opening 162.

Each block body 152 is spring-biased upwardly in the vertical direction by a suitable resilient biasing member that acts directly or indirectly on the block body 152. For example, in the example illustrated in FIG. 8, a vacuum port fitting 200 that is in fluid communication with the vacuum orifice 56 is disposed at the base of the block body 152. A spring tab 202 that is fixed to the cleaning carriage acts on the vacuum port fitting 200 to resiliently bias the block body 152 vertically upward.

A flush port fitting 204 that is in fluid communication with the flush orifice 54 is fixed to the side of the block body 152. Cleaning fluid for cleaning the nozzle plate of the associated print head is introduced into the block body 152 via the flush port fitting 204 and then flows to the flush orifice 54.

Figure 7:
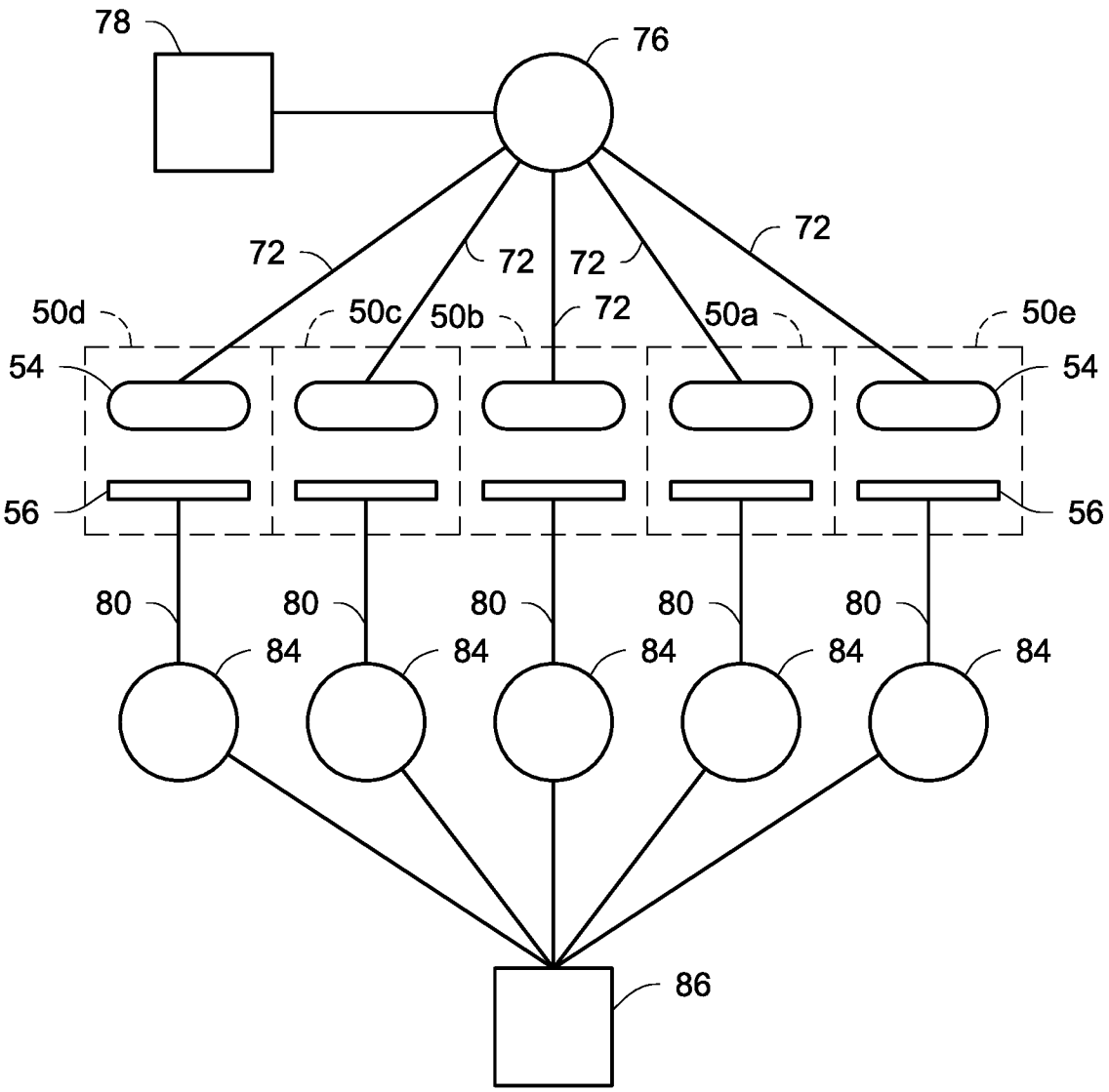
FIG. 7 is a schematic diagram of the cleaning solution system and the vacuum system of the cleaning mechanism.

Referring to FIGS. 4 and 7, the flush orifice 54 is in fluid communication with a flush channel 72 that is formed in the block body 52. Each flush channel 72 is fluidly connected to the output of a pump 76 such as a peristaltic pump. The inlet of the pump 76 is connected to a cleaning fluid tank 78 that contains a refillable supply of cleaning fluid. The cleaning fluid can be any fluid that is suitable for cleaning the nozzle plates 36, such as water, a solution of water and a cleaning agent, or other cleaning fluid. In another embodiment, each flush channel 72 can be fluidly connected to a fluid manifold (not shown) that in turn is connected to the output of the pump 76.

Still referring to FIGS. 4 and 7, the vacuum orifice 56 is in communication with a vacuum channel 80 that is formed in the block body 52. Each vacuum channel 80 is connected to the inlet of its own vacuum pump 84. The outlets of the vacuum pumps 84 are connected to a waste storage tank 86 (or connected to separate waste storage tanks 86) into which cleaning fluid and loosened debris and other debris can be discharged when suctioned from the nozzle plates 36 by the vacuum orifices 56. In another embodiment, each vacuum channel 80 can be fluidly connected to a vacuum manifold that is connected to the inlet of a single vacuum pump 84.

Operation of the automated cleaning mechanism 28 will now be described with reference to FIGS. 6A and 6B. The automated cleaning mechanism 28 can perform a cleaning operation at any desired time, for example upon receiving a cleaning command entered by a human operator of the card processing system 10, automatically after the card processing system 10 has processed a predetermined number of cards, automatically after the card processing system 10 has finished processing a batch of cards, automatically upon power up or power down of the card processing system 10, or the like.

Figure 6A:
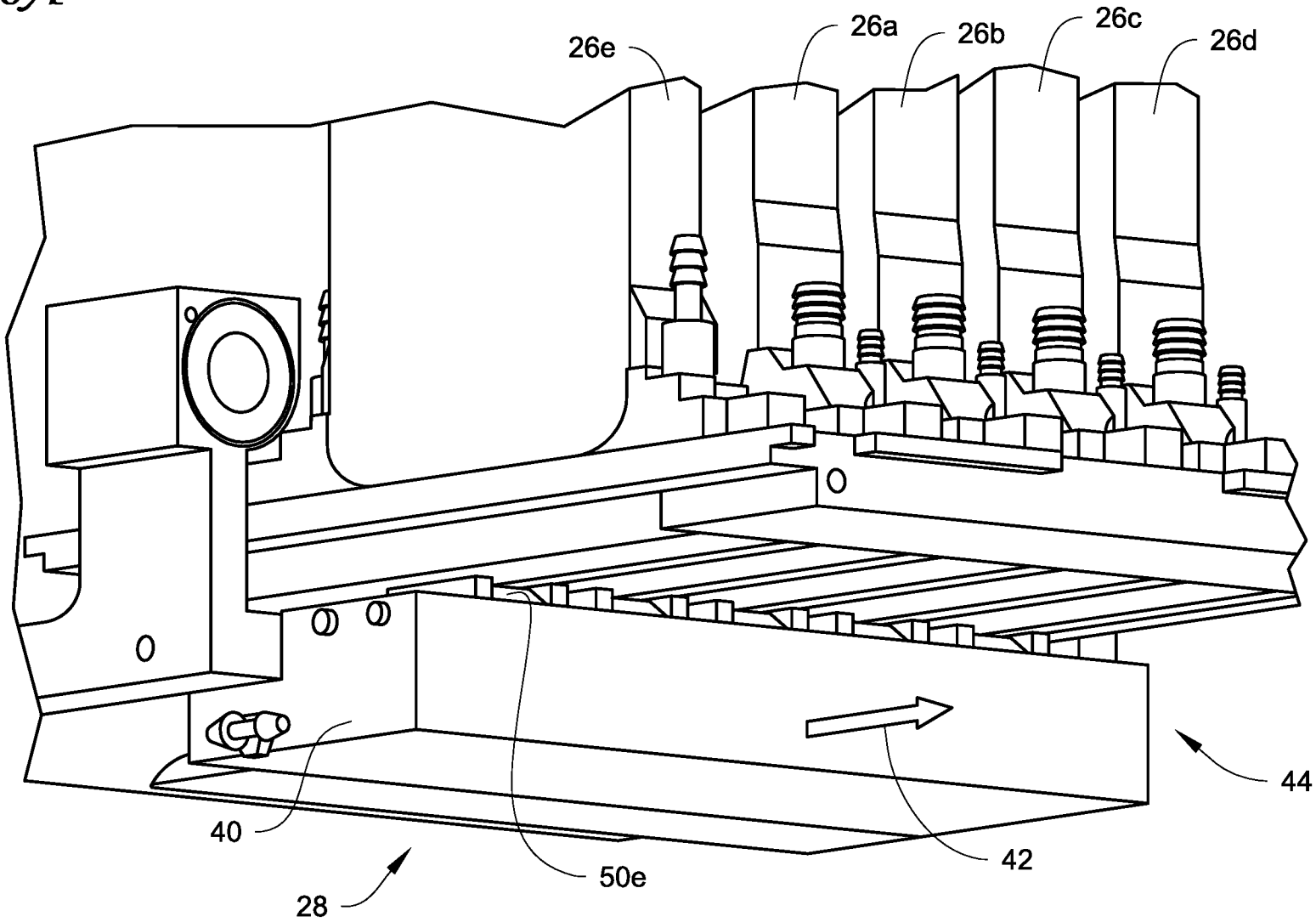
FIG. 6A illustrates the movement of the cleaning mechanism during application of a cleaning fluid to the nozzle plates of the print heads.

FIG. 6A shows the cleaning carriage 40 after it has moved away from the home position and has reached a position where the cleaning assembly 44 is ready to apply cleaning fluid to the nozzle plates 36 of the print heads 26*a-e*. If the cleaning assembly 44 is configured with the cleaning blocks 50*a-e* as described above, the pump 76 is then activated to pump cleaning fluid to the flush orifices 54. A dome of cleaning fluid is created at each flush orifice 54 with the cleaning fluid dome extending above the flush orifice a sufficient distance to contact the associated nozzle plate 36. As the cleaning carriage 40 continues traveling in the direction of the arrow 42 in FIG. 6A, the cleaning fluid is applied to the nozzle plate 36. The cleaning carriage 40 continues traveling in the direction of the arrow 42 in FIG. 6A until the cleaning fluid is applied to substantially the entire face of each nozzle plate 36, at which time the pump 76 is stopped.

Figure 6B:
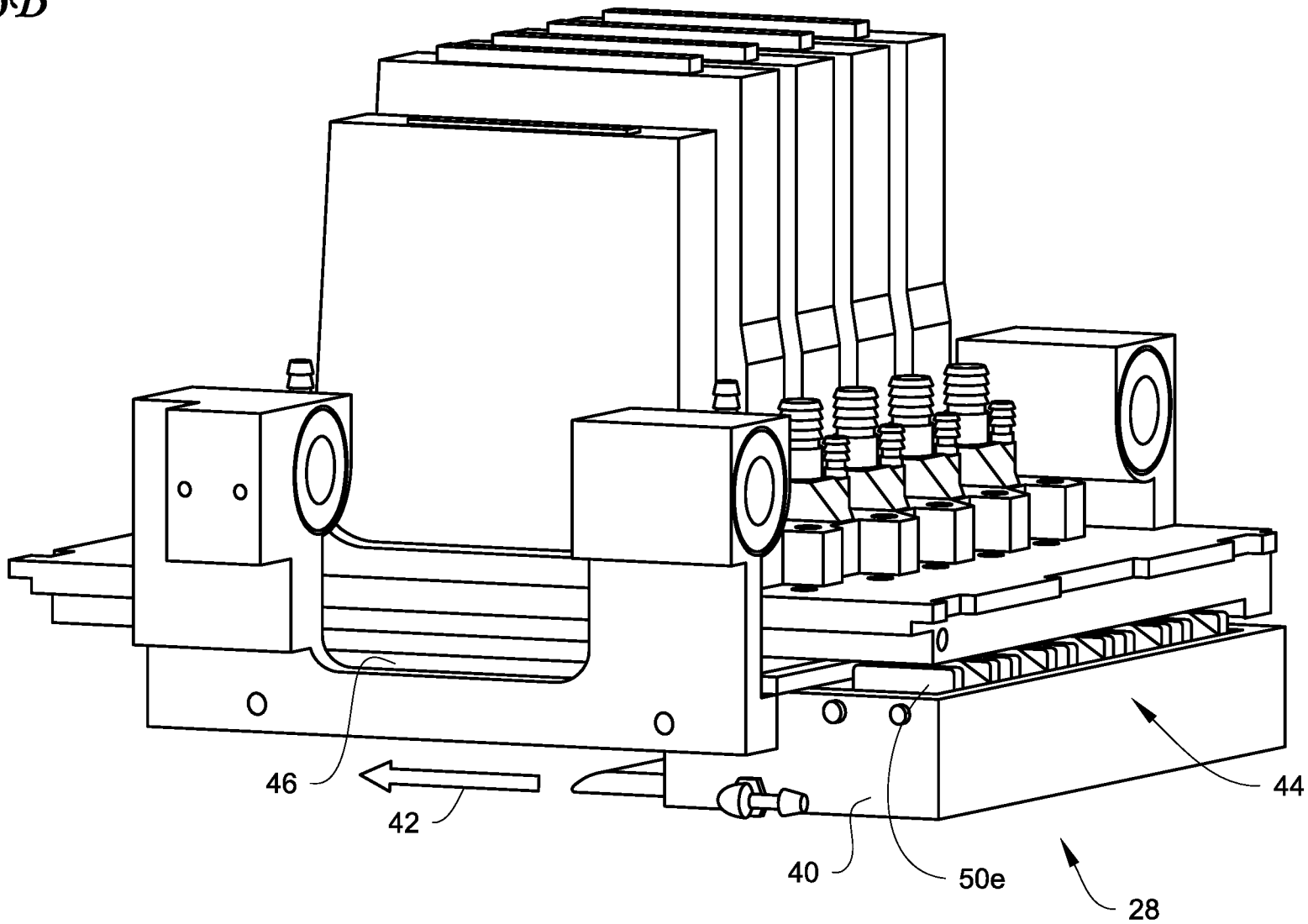
FIG. 6B illustrates the movement of the cleaning mechanism during removal of the cleaning fluid from the nozzle plates of the print heads.

The cleaning carriage 40 eventually reaches the position (which can be referred to as a soak position) shown in FIG. 6B where the drip tray 46 is positioned underneath the print heads 26*a-e*. In some embodiments, the cleaning carriage 40 can remain at this position for a predetermined period of time to allow the cleaning fluid on the nozzle plates 36 to soften any ink or other debris on the nozzle plates 36. Alternatively, the cleaning carriage 40 can immediately return toward the home position shown in FIG. 2. As the cleaning carriage 40 returns toward the home position in the direction of the arrow 42 in FIG. 6B, the vacuum pumps 84 are activated to create a vacuum in the vacuum orifices 56. As the vacuum orifices 56 travel underneath the nozzle plates 36, they suction cleaning fluid and loosened ink and other debris from the nozzle plates 36. Once the vacuum orifices 56 traverse under the entire length of the nozzle plates 36, the vacuum pumps 84 are stopped and the cleaning carriage 40 continues traveling to the home position.

In another embodiment, a cleaning sequence can be implemented where a cleaning fluid is not applied to the nozzle plate(s) 36. Instead, in this alternative cleaning sequence, with the cleaning carriage 40 in the soak position shown in FIG. 6B where the drip tray 46 is positioned underneath the print heads 26*a-e*, ink can be forced through the nozzles of one or more of the nozzle plate(s) 36 for unclogging individual nozzles. After the ink is forced through the nozzle plate(s) 36, the cleaning carriage 40 is returned toward the home position in the direction of the arrow 42 in FIG. 6B and the vacuum pump(s) 84 are activated so that the vacuum orifices 56 remove residual ink from the nozzle plate(s) 36 as the cleaning carriage 40 returns to the home position.

When UV curable ink is used for the printing, the card processing system described herein may be configured as what may be referred to as a desktop card processing system. Such a desktop card processing system would include at least a card input and a card output (which may be at opposite ends of the system or at the same end of the system), a DOD card printing system that prints on the cards using UV curable ink, and a UV cure station for curing the UV curable ink applied to the card. Additional card processing systems, such as those described above, may also be included. A desktop card processing system is typically designed for relatively small scale, individual card processing. In desktop processing systems, a single card to be processed is input into the system, processed, and then output. These systems are often termed desktop machines or desktop printers because they have a relatively small footprint intended to permit the machine to reside on a desktop. Many examples of desktop machines are known, such as the SD or CD family of desktop card machines available from Entrust Datacard Corporation of Shakopee, Minn. Other examples of desktop card machines are disclosed in U.S. Pat. Nos. 7,434,728 and 7,398,972, each of which is incorporated herein by reference in its entirety.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method, comprising:

in a card processing system, processing a plurality of cards, wherein the processing includes:

at least one of reading data from and/or writing data to a magnetic stripe on each card in a magnetic stripe reading/writing system and programming data on an integrated circuit chip on each card in an integrated circuit chip programming system;

printing on each card in a drop-on-demand card printing system using ultraviolet curable ink, the drop-on-demand card printing system includes at least one drop-on-demand print head having a nozzle plate; and curing the ultraviolet curable ink applied to each card;

cleaning the nozzle plate of the at least one drop-on-demand print head using a cleaning mechanism in the drop-on-demand card printing system, wherein the cleaning mechanism is configured to clean the nozzle plate of the at least one drop-on-demand print head without the cleaning mechanism physically contacting the nozzle plate.

2. The method of claim 1, wherein cleaning the nozzle plate includes:

applying a cleaning fluid to a surface of the nozzle plate using a cleaning block of the cleaning mechanism without the cleaning block physically contacting the nozzle plate;

using a vacuum orifice on the cleaning block to remove the cleaning fluid from the nozzle plate without the cleaning block physically contacting the nozzle plate.

3. The method of claim 1, wherein cleaning the nozzle plate includes:

forcing ink through the nozzle plate;

using a vacuum orifice on a cleaning block of the cleaning mechanism to remove residual ink from the nozzle plate without the cleaning block physically contacting the nozzle plate.

* * * * *